US005365315A

United States Patent [19]

Baker et al.

[11] Patent Number: 5,365,315

[45] Date of Patent: Nov. 15, 1994

[54] IMAGING DEVICE WITH CARTRIDGE AND LID INTERACTION

[75] Inventors: Ronald W. Baker, Versailles; Robert L. Burdick, Nicholasville; Martin V. DiGirolamo; Paul D. Horrall, both of Lexington; Larry J. Rice, Nicholasville; Ronald L. Roe, Lexington; Earl D. Ward, II, Lexington; Bernard L. Wilzbach, Lexington, all of Ky.

[73] Assignee: Lexmark International, Inc., Greenwich, Conn.

[21] Appl. No.: 99,814

[22] Filed: Jul. 29, 1993

[51] Int. Cl.[5] ..... G03G 15/00

[52] U.S. Cl. ..... 355/210; 355/200

[58] Field of Search ..... 355/200, 210, 211, 215

[56] References Cited

U.S. PATENT DOCUMENTS

| | | | |
|---|---|---|---|
| 3,966,316 | 6/1976 | Pfeifer et al. | 355/200 |
| 4,538,896 | 9/1985 | Tajima et al. | 355/200 |
| 5,047,801 | 9/1991 | Haneda et al. | 355/200 |
| 5,083,158 | 1/1992 | Kashima et al. | 355/200 |
| 5,095,334 | 3/1992 | Nukaya | 355/210 |
| 5,095,335 | 3/1992 | Watanabe et al. | 355/210 |
| 5,113,220 | 5/1992 | Kwak | 355/200 |
| 5,231,453 | 7/1993 | Nakai et al. | 355/210 |

*Primary Examiner*—A. T. Grimley
*Assistant Examiner*—Nestor R. Ramirez
*Attorney, Agent, or Firm*—John A. Brady

[57] ABSTRACT

The charging roller (42) and push plates (44) are spring mounted to the lid (36) of the printer. When the lid is closed, the plates push plungers (11) down to rotate crank arms (23), which open a shutter (7) in electrophotographic cartridge (1). This holds the cartridge in place and provides both a resilient, protective cushion for the cartridge and a pop-up action to the lid.

7 Claims, 5 Drawing Sheets

IMAGING DEVICE WITH CARTRIDGE AND LID INTERACTION

TECHNICAL FIELD

This invention relates to an electrophotographic imaging device employing a toner cartridge which is under a closed lid during use. With such a device the cartridge must be suitably positioned and held in place during operation while the lid is closed.

BACKGROUND OF THE INVENTION

Imaging devices with operative elements in the lid are known, as established by the following: U.S. Pat. Nos. 3,966,316 to Pfeifer et al; 4,538,896 to Tajima et al; 5,047,801 to Haneda et al and 5,095,334 to Nukaya. The Pfeifer et al and Tajima et al patents both have in the lid the light source for imaging and the electrical charging source for a photoconductor, and both have elements in the lid which physically interact to position removable members in the printer. This interaction, however, is by positioning rollers, while the interaction of the subject invention is by multiple, resiliently mounted pressure members. The Haneda et al and Nukaya patents have an electrical charging source and paper feed elements in the lid and removable printing elements on which the lid closes, and have nothing similar to the multiple, resiliently mounted pressure members of this invention.

DISCLOSURE OF THE INVENTION

The subject invention has a charging roller mounted in the lid on spring members, as well as the optical element in the lid. The lid also carries pivoted, spring biased plates on opposite sides. The main body of the printer receives a toner cartridge immediately under the location of the closed lid which has plunger rods positioned under the spring biased plates and pivotally attached to crank arms. The cartridge has an upper shutter which is pivotally mounted on each side of the cartridge.

Closing of the lid brings the plates into contact with the rods, which pivot the crank arms to contact the shutter mounting. The shutter is moved open and the mounting continues to receive downward force through the rods. The shutter first moves to expose the photoconductor drum and the further movement of the lid brings the charge roller in contact with the photoconductor drum. The bias mounting of the charge roller provides further downward force on the cartridge.

Should the lid be open and accidently dropped or pushed toward the closed position, the biased plates first contact the rods to cushion the movement by the bias of the rods. Continued movement is further cushioned by the spring bias of the plates, thereby avoiding damage to elements in or near the lid and injury to persons near the lid. When the lid is opened, the spring mounting gives a decisive, "pop-up" response.

BRIEF DESCRIPTION OF THE DRAWING

The details of this invention will be described in connection with the accompanying drawing, in which.

BEST MODE FOR CARRYING OUT THE INVENTION

Figure 1:
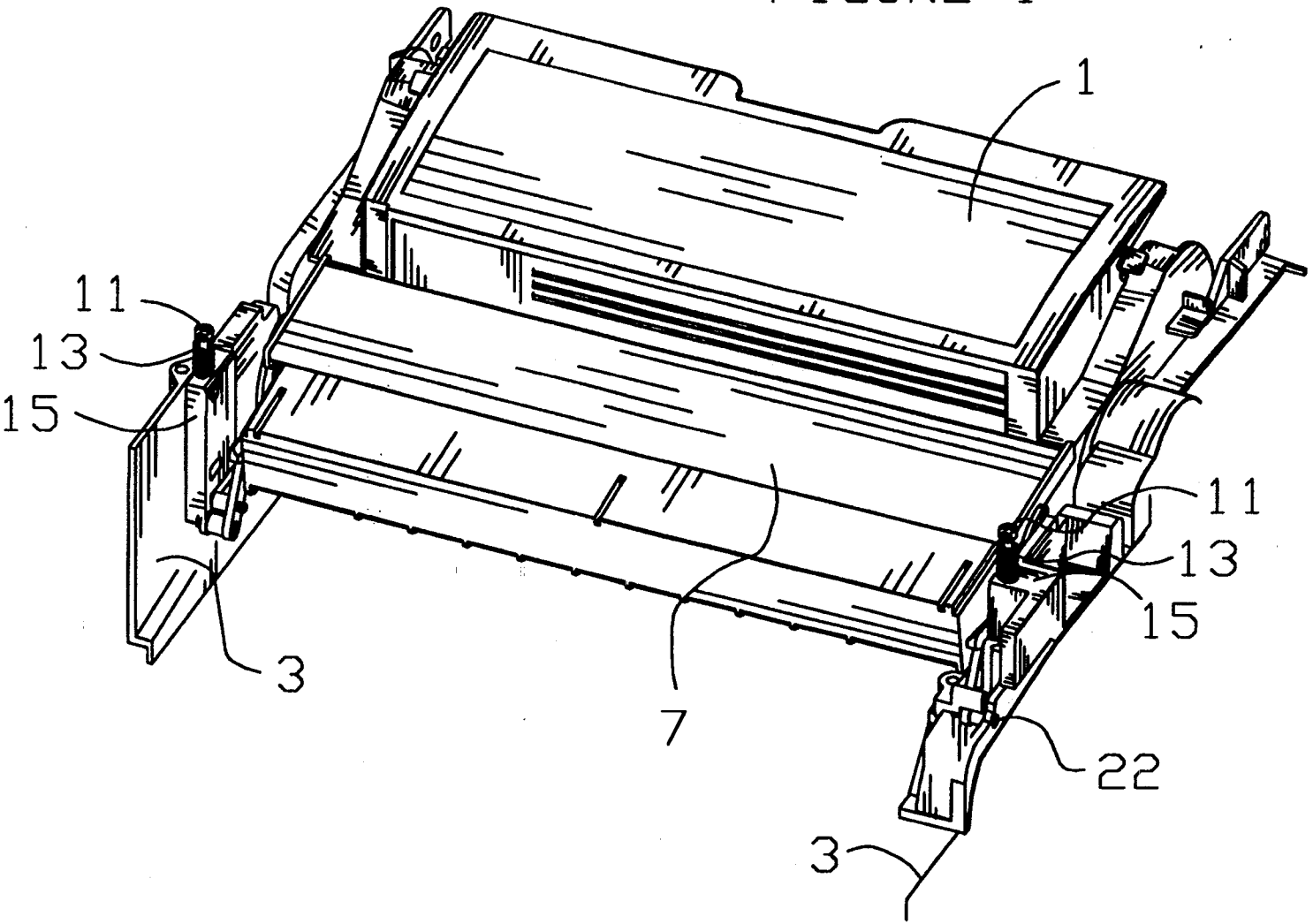
FIG. 1 is a perspective view showing the toner cartridge mounted in the imaging device prior to closing of the lid.
Figure 3:
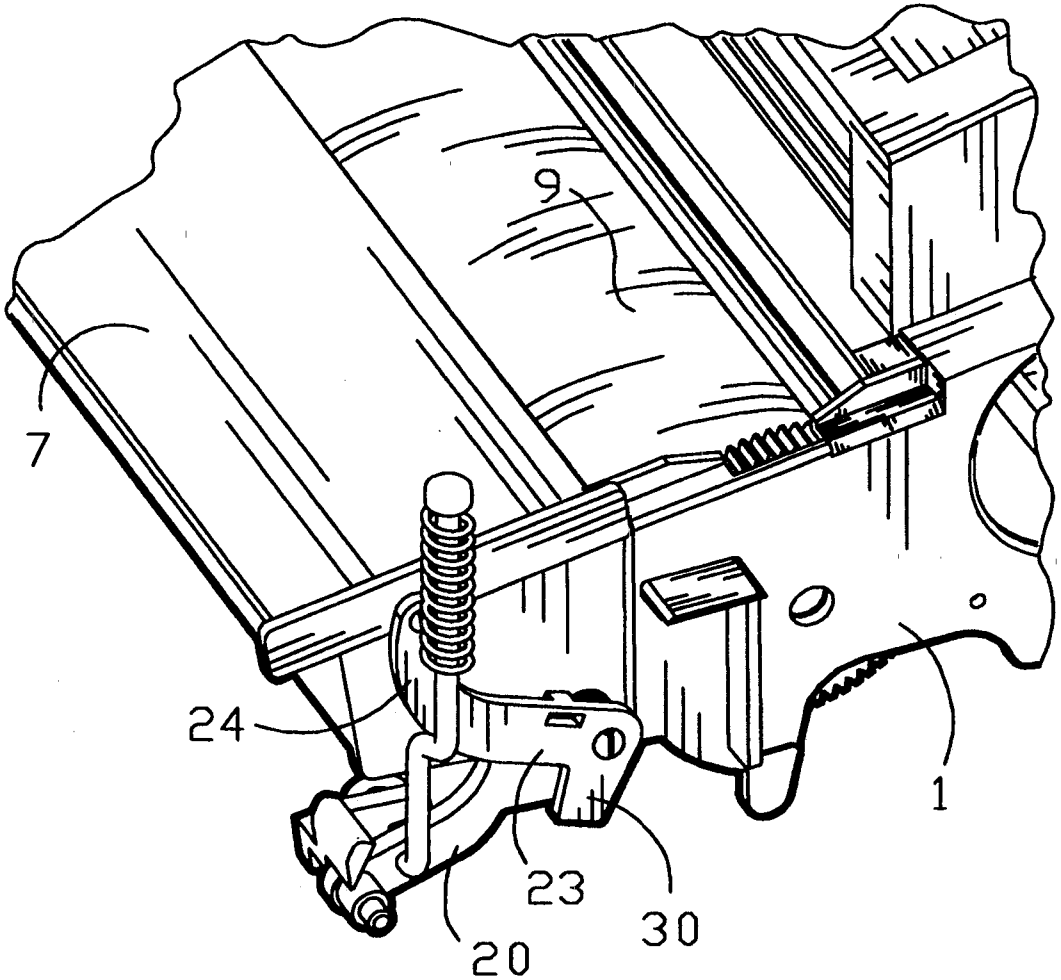
FIG. 3 is an enlarged perspective view similar to FIG. 2 showing the crank and hold mechanism in the open position.
Figures 4, 4A:
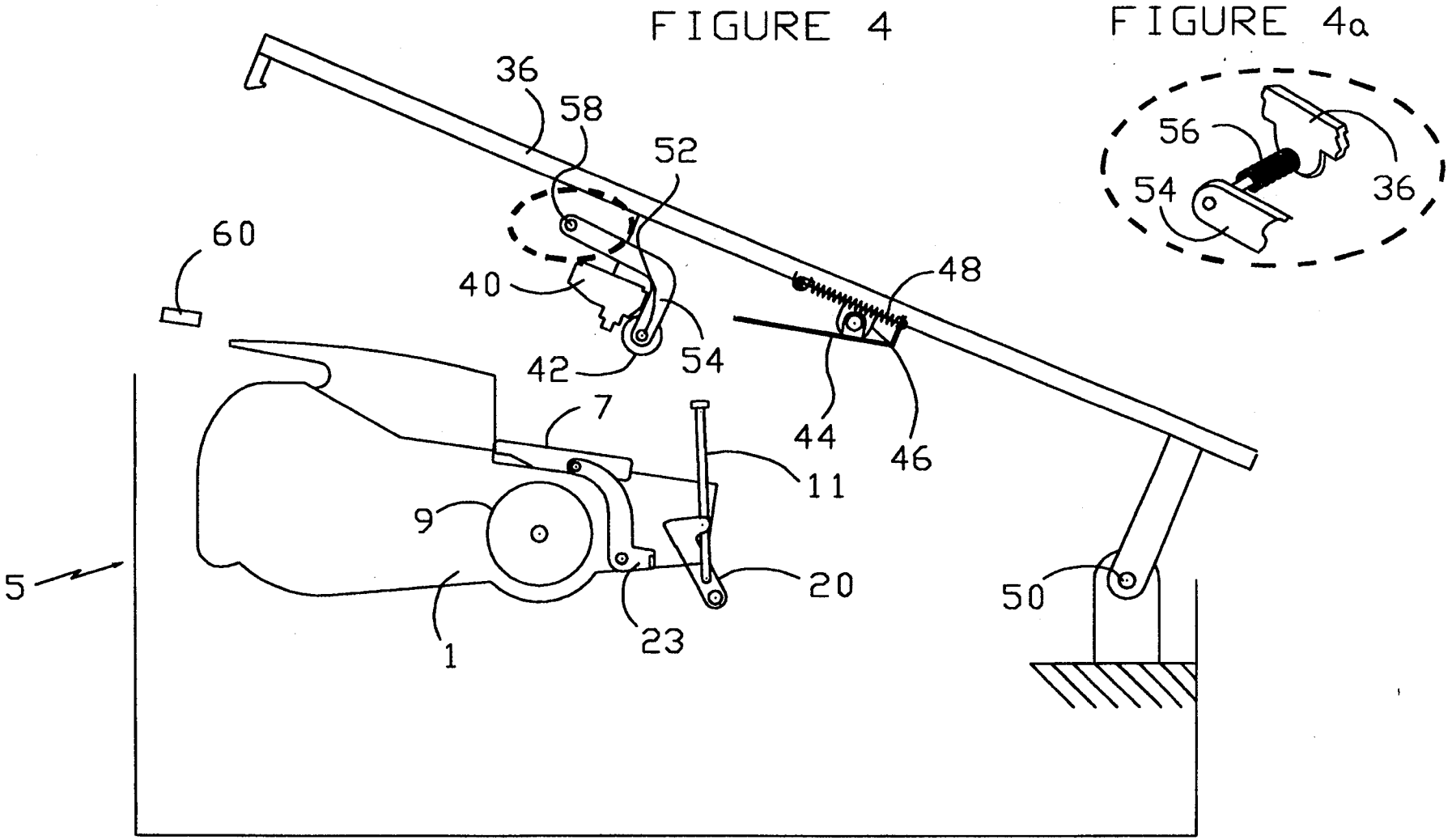
FIG. 4 is a side view showing the lid and cartridge and crank and hold mechanism with the lid opened.
FIG. 4*a* is a perspective view including the pivoting arm where circled by dashed lines in FIG. 4.
Figure 5:
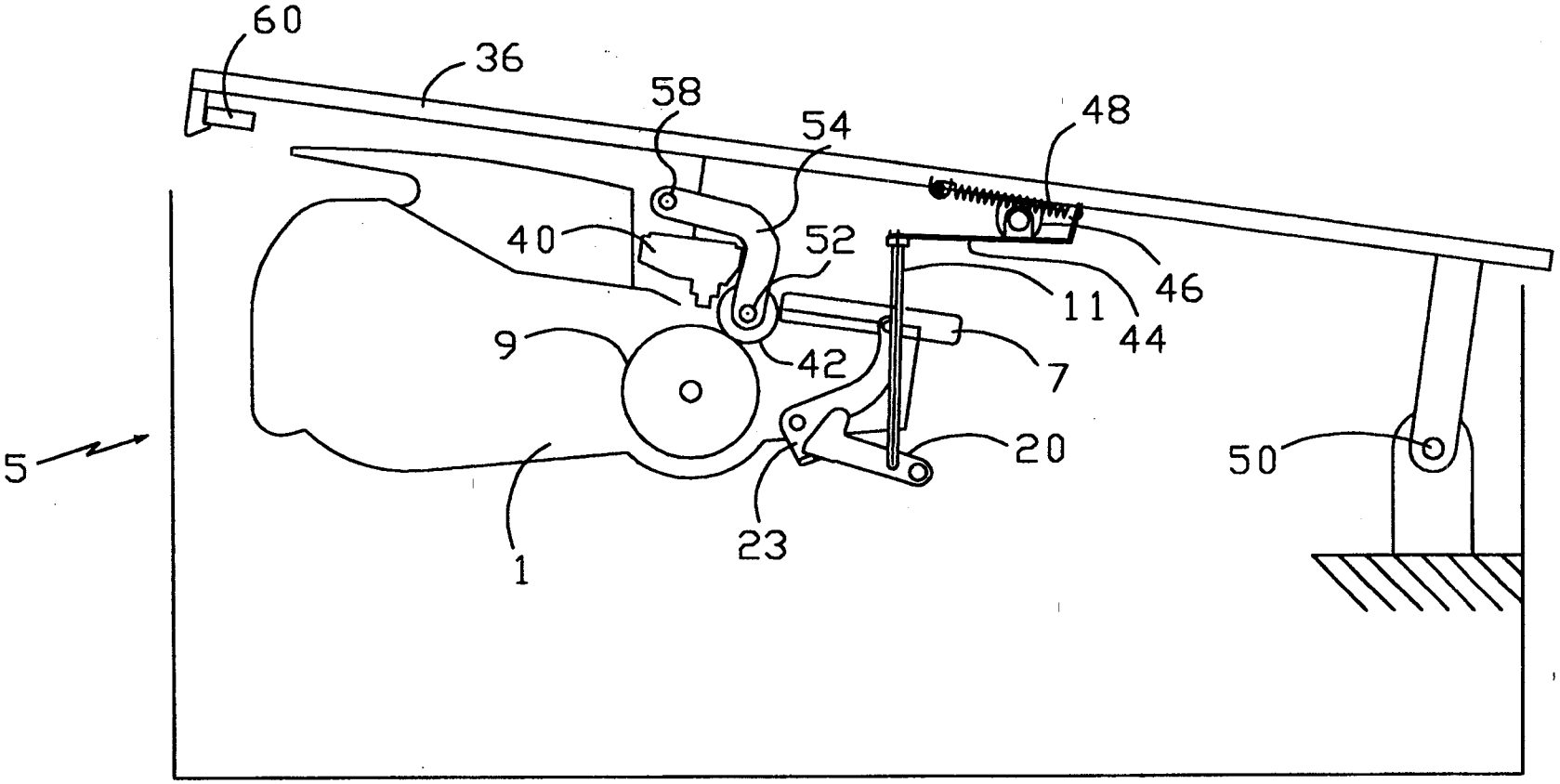
FIG. 5 is the same view as FIG. 4 with the lid closed.

FIG. 1 illustrates the electrophotographic toner cartridge 1 installed in base members 3 of a printer 5 (FIG. 4). Cartridge 1 has a top shutter 7 which is pivoted open as will be described to uncover a photoconductor drum 9 (FIG. 3). Base members 3 each supports a plunger rod 11, which are biased upward by a coil spring 13 surrounding each rod 11. Springs 13 abut on an upper surface 15 of each base member 3.

Figure 2:
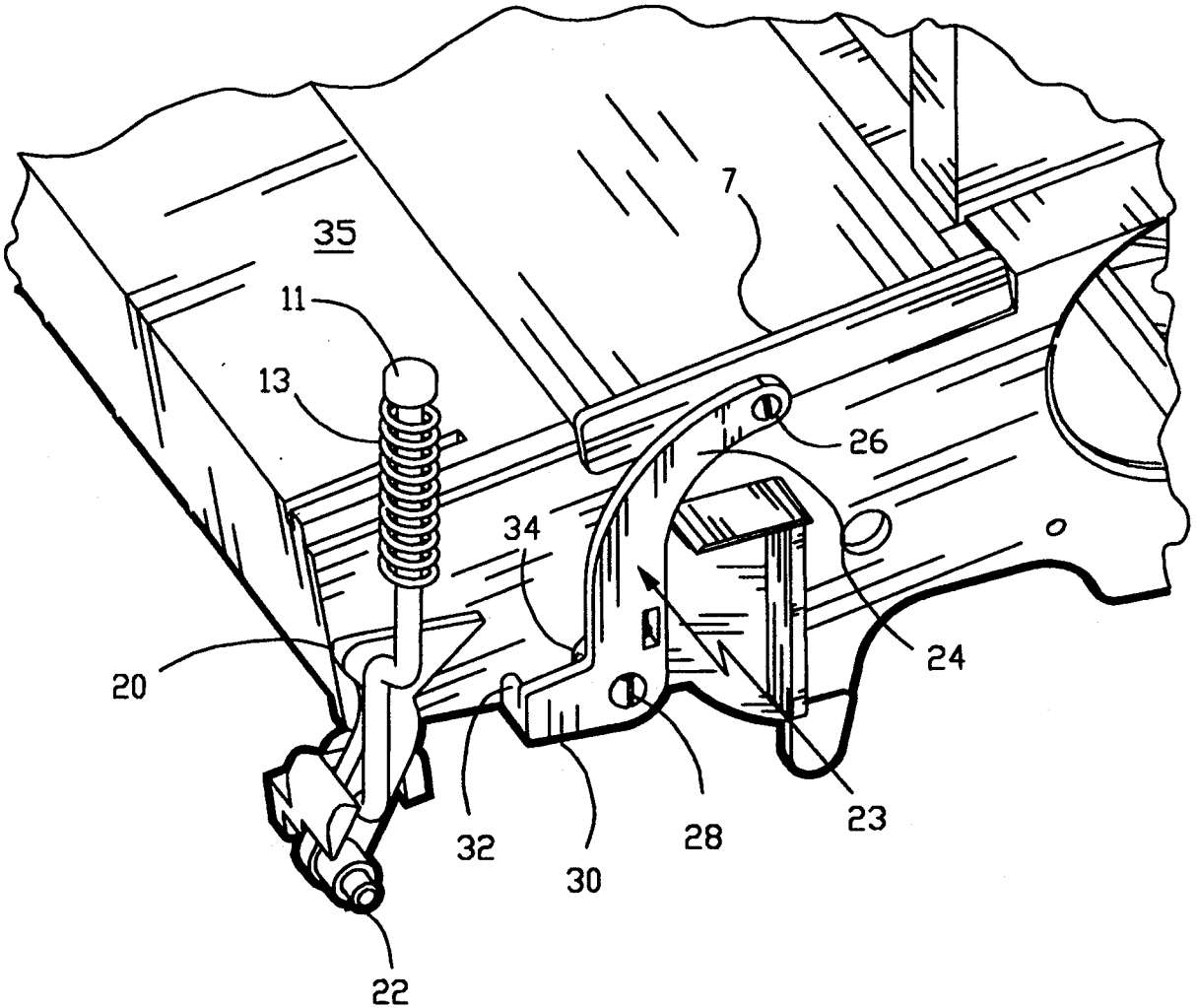
FIG. 2 is a detailed view, slightly in perspective of the crank and hold mechanism for the shutter.

FIG. 2 is a more detailed view of significant elements which pivots open shutter 7. Elements on opposite sides of the cartridge 1 are the identical, mirror-image of those shown in FIG. 2. Plunger rod 11 is pivotally connected to crank arm 20 at a location spaced from pivot pin 22, which is pivoted in base member 3 (FIG. 1).

Arm 23 has a arc-shaped portion 24 which is pivotally attached at one end by pin 26 to shutter 7. Arm 23 is pivotally attached to cartridge 1 by pin 28 at the other end of arc-shaped portion 24. Arm 23 has straight portion 30 at approximately a right angle to portion 24. The end of portion 30 carries an abutment member 32 which extends toward cartridge 1 in a position to be engaged by the end of crank arm 20 opposite pivot pin 22. Torsion spring 34 around pin 28 connects arm 23 and cartridge 1 to tend to rotate arm 23 so as to close shutter 7.

In operation, push plates 44 of the lid 36 (FIG. 4) of printer 5 pushes down on both plunger rods 11 when lid 36 is closed. This rotates crank arms 20 clockwise with respect to FIG. 2. The rotation causes arm 20 to engage abutment 32 and to then rotate the arm 23. Rotation terminates when abutment 32 encounters the floor of base member 3 (FIG. 1). FIG. 3 shows these members in their final position after lid 36 is closed. This takes place identically on both sides of cartridge 1. Shutter 7 is moved slightly upward on the arc of portion 24, but primarily moves laterally, where it then rests in the open position on an upper surface 35 (FIG. 2) of cartridge 1.

FIG. 4 shows printer 5 (shown largely symbolically) with lid 36 open. Lid 36 has mounted to it light emitting diode printhead 40, charge roller 42, and, on each side of lid 36 positioned to contact each plunger rod 11, a push plate 44. Each push plate 44 is pivoted on a bracket 46 mounted to the underside of lid 36 and biased by spring 48 with one end connected between plate 44 on the side toward hinge 50 of lid 36 and with the opposite end of spring 48 connected to lid 36. Charge roller 42 is mounted on each side of lid 36 by a bushing 52 which is mounted in pivoting arm 54. Arm 54 rotates about pivot shaft 58. Torsion spring 56 (FIG. 4*a*), mounted on shaft 58 provides a downward force for charge roll 42 against photoconductor drum 9. An identical, biased mounting of charge roller 42 (not shown) exists near the opposite end of charge roller 42. In the closed position lid 36 is held by a latch 60, which may be a conventional, yieldable member.

For use in printing, cartridge 1 is initially positioned in printer 5 with no positive downward restraint except gravity. (Studs on cartridge 1 (not shown) slide into slots in printer 5 to position cartridge 1 laterally.) Lid 36 is then closed by manual pivoting with respect to hinge 50. The first mechanical interaction is each push plate 44 engaging the top of its corresponding plunger rod 11. Resistance from springs 13 is less than the resistance of springs 48, so rods 11 are pushed downward and push plates 44 do not pivot. As lowering of lid 36 continues, shutter 7 is opened as described and then charge roller 42 engages photoconductor 9. Crank arm 20 reaches its limit when abutment 32 encounters base 3. Further movement of lid 36 then pivots plates 44 against the force of springs 48. Charge roller 42 also moves on arms 54 to rotate torsion springs 56.

The forces of springs 56 and 48 are thus transferred to two locations on cartridge 1 which are somewhat displaced laterally. These secure cartridge 1 vertically. When latch 60 is released, springs 48 and 56 act to positively lift lid 36 a short distance, which is convenient to the operator (i.e. lid 36 "pops" open). If lid 36 is dropped or pushed downward accidentally or too hard, spring 48 is engaged to damp movement before LED 40 and charge roller 42 or other elements can make contact and therefore be damaged and before injury can occur to the operator by lid 36 slamming shut.

Modifications within the spirit and scope of this invention can be anticipated since this invention is not dependent on the specifics shown.

What is claimed is:

1. An imaging apparatus comprising a removable cartridge containing toner, a photoconductive member and a shutter covering said photoconductive member when closed, a movable lid for said imaging apparatus carrying an optical member to selectively expose said photoconductive member and a charging member to electrically charge said photoconductive member, a biased push plate pivotally attached to said lid, a plunger resiliently mounted on said apparatus separate from said cartridge and positioned to contact said push plate as said lid closes, a pivotally mounted first crank arm pivotally connected to said plunger, and a second crank arm pivotally mounted on said cartridge and connected to said shutter to open and close said shutter, said first crank arm being located to rotate said second crank arm to open said shutter when said lid closes on said plunger.

2. The imaging apparatus as in claim 1 in which said charging member is a spring mounted roller.

3. The imaging apparatus as in claim 2 in which said push plate is spring mounted with a spring of force to not yield while said first crank arm rotates said second crank arm to open said shutter and to then yield as said lid is further closed.

4. The imaging apparatus as in claim 1 in which said push plate is spring mounted with a spring of force to not yield while said first crank arm rotates said second crank arm to open said shutter and to then yield as said lid is further closed.

5. A removable toner cartridge for an imaging apparatus having a photoconductor member and a moveable shutter covering said photoconductor member in one position, said cartridge having two crank arms, each pivotally connected to said cartridge on opposite sides of said shutter, each said crank arm having a first portion pivotally connected to said shutter on one side of said pivot to said cartridge and a second portion having an abutment surface extending toward said cartridge for rotating said crank on the other side of said pivot to said cartridge, said first portion being arc-shaped extending generally from said pivot to said cartridge toward said shutter and then extending generally toward said pivotal connection to said shutter.

6. An imaging assembly for receiving removable toner cartridge to form a complete imaging apparatus having a lid on which is mounted a light source for imaging a photoconductor member in said cartridge when said lid is closed, a charge roller for contacting and charging said photoconductor member when said lid is closed, said charge roller being resiliently mounted on mounting apparatus to form a firm contact with said photoconductor member when said lid is closed, and a push plate resiliently mounted independent of said mounting apparatus of said charge roller on said lid, and a plunger mounted in said assembly located to contact said plate as said lid is closed.

7. The imaging apparatus as in claim 6 in which said push plate is pivotally mounted with a spring of force to not yield while said plunger moves a first distance and to then yield as said lid is further closed.

* * * * *